US012398553B2

(12) United States Patent
Nouh et al.

(10) Patent No.: US 12,398,553 B2
(45) Date of Patent: Aug. 26, 2025

(54) METAMATERIAL WITH TEMPORALLY VARYING ELASTIC PROPERTIES

(71) Applicant: The Research Foundation for The State University of New York, Amherst, NY (US)

(72) Inventors: Mostafa Nouh, Clarence Center, NY (US); Mohammad Ali Attarzadeh, Amherst, NY (US); Jesse Callanan, Buffalo, NY (US)

(73) Assignee: The Research Foundation for The State University of New York, Amherst, NY (US)

( * ) Notice: Subject to any disclaimer, the term of this patent is extended or adjusted under 35 U.S.C. 154(b) by 829 days.

(21) Appl. No.: 17/507,798

(22) Filed: Oct. 21, 2021

(65) Prior Publication Data

US 2024/0287786 A1 Aug. 29, 2024

Related U.S. Application Data

(60) Provisional application No. 63/094,876, filed on Oct. 21, 2020.

(51) Int. Cl.
*E04B 1/28* (2006.01)

(52) U.S. Cl.
CPC ..... *E04B 1/28* (2013.01)

(58) Field of Classification Search
CPC ..... E04B 1/28; E04B 1/00
USPC ..... 52/1, 573.1
See application file for complete search history.

(56) References Cited

U.S. PATENT DOCUMENTS 7,877,942 B2 * 2/2011 Tochev ..... E06B 3/677 52/656.5
8,117,788 B1 * 2/2012 Mueller ..... E04H 9/0237 52/573.1
8,748,749 B2 * 6/2014 Srinivas ..... H05K 1/0298 428/323
8,844,205 B2 * 9/2014 Michael ..... F16F 9/303 52/167.8

(Continued)

FOREIGN PATENT DOCUMENTS

CN 211923206 U * 11/2020 ..... E04B 1/8404
CN 117496934 A * 2/2024 ..... B32B 3/08

(Continued)

*Primary Examiner* — Ryan D Kwiecinski
(74) *Attorney, Agent, or Firm* — Hodgson Russ LLP

(57) ABSTRACT

Embodiments of the present disclosure include metabeams with nonreciprocal dispersion. A host beam has a length along a longitudinal axis and is configured to vibrate (oscillate) over its length. The vibration may be in a first direction perpendicular to the length of the host beam. A plurality of first resonators may be arranged in an array along the length of the host beam and extending from the host beam in a second direction which forms an angle (>0°) with respect to the first direction and an angle (>0°) with respect to the longitudinal axis of the host beam. Each first resonator has an arm having a first end attached to the host beam and an arm axis. The arm has a stiffness in the first direction which is selectively variable. A mass may be attached to the arm at a location which is spaced from the first end by a first distance. The stiffness of each first resonator arm is configured to be varied to impart nonreciprocal dispersion in the host beam.

9 Claims, 6 Drawing Sheets

(56) References Cited

U.S. PATENT DOCUMENTS 8,919,066 B2 * 12/2014 Ovaert ..... E04F 15/22 52/177
9,206,616 B2 * 12/2015 Sarlis ..... E04H 9/0215
10,060,851 B2 * 8/2018 Kim ..... H01J 37/32009
10,829,926 B2 * 11/2020 Adachi ..... E04B 1/2604
10,860,101 B1 * 12/2020 Menguc ..... G06F 3/017
11,195,504 B1 * 12/2021 Hammetter ..... B33Y 80/00
11,584,505 B1 * 2/2023 Hundley ..... G10K 11/172
11,727,909 B1 * 8/2023 Mathur ..... G10K 11/162 181/207
2007/0204545 A1 * 9/2007 Ovaert ..... E04F 15/22 52/389
2008/0302024 A1 * 12/2008 Browne ..... E04B 1/00 52/1
2011/0061310 A1 * 3/2011 Browne ..... E04B 1/00 52/741.1
2011/0281070 A1 * 11/2011 Mittal ..... B05D 3/007 428/221
2012/0132930 A1 * 5/2012 Young ..... H05K 1/0313 257/E31.127
2013/0025961 A1 * 1/2013 Koh ..... G10K 11/162 181/207
2016/0027427 A1 * 1/2016 Yang ..... G10K 11/172 181/286
2017/0125656 A1 * 5/2017 Hussein ..... H10N 10/81
2018/0309039 A1 * 10/2018 Hussein ..... H10N 10/857
2019/0035373 A1 * 1/2019 Chunren ..... G10K 11/162
2019/0292768 A1 * 9/2019 Yates ..... E04B 1/19
2021/0193101 A1 * 6/2021 Sugiura ..... B32B 27/40
2022/0051650 A1 * 2/2022 Lee ..... G10K 11/172
2024/0287786 A1 * 8/2024 Nouh ..... E04B 1/28

FOREIGN PATENT DOCUMENTS

CN 118346734 A * 7/2024
DE 102011050841 A1 * 12/2012 ..... H01Q 21/0075
EP 4040008 A1 * 8/2022 ..... F16F 7/116
JP 2020140138 A * 9/2020
RU 153274 U1 * 7/2015
TW 201215932 A * 4/2012 ..... B05D 3/002
WO WO-2024023838 A1 * 2/2024

* cited by examiner $$k(\theta) \cong k_0 + k_1 \cos(2\theta)$$

Fig. 3(a) IR Thermal camera Fig. 3(b) SLDV

Fig. 3(c) Piezo-actuator Fig. 3(d) Motor control circuit

Fig. 3(e) Unit cell Fig. 3(f) Exp. setup

Fig. 4 (a)
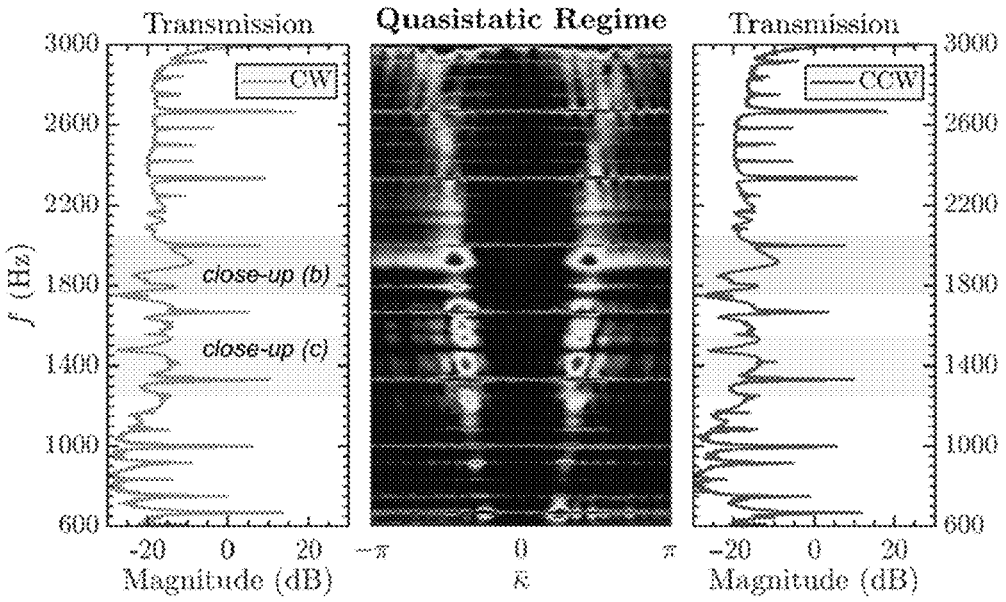
Fig. 4 (b)
Fig. 4 (c)
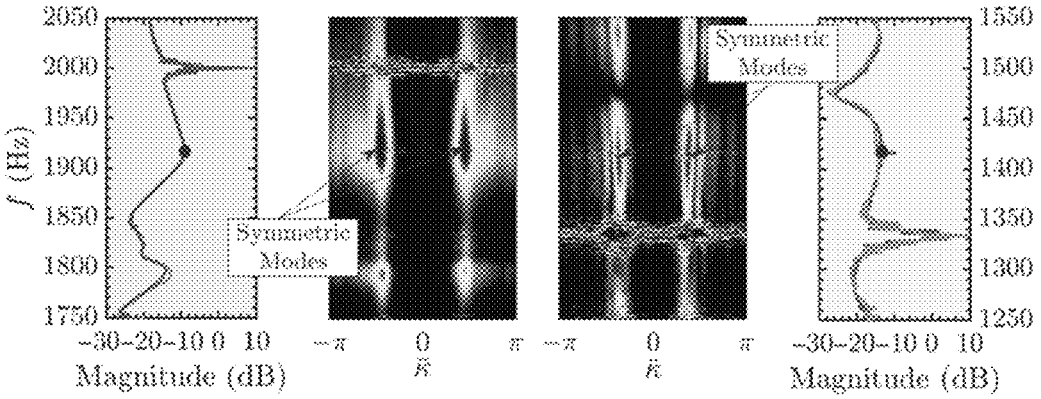

METAMATERIAL WITH TEMPORALLY VARYING ELASTIC PROPERTIES

CROSS-REFERENCE TO RELATED APPLICATIONS

This application claims priority to U.S. Provisional Application No. 63/094,876, filed on Oct. 21, 2020, now, the disclosure of which is incorporated herein by reference.

STATEMENT REGARDING FEDERALLY SPONSORED RESEARCH

This invention was made with government support under contract no. 1847254 awarded by the National Science Foundation. The government has certain rights in the invention.

FIELD OF THE DISCLOSURE

The present disclosure relates to metamaterials.

BACKGROUND OF THE DISCLOSURE

The ability to control wave propagation in elastic media is of key importance in a number of disciplines that span multiple geometric scales. Resonant and periodic materials aim to provide a means to mitigate or guide elastic waves via precisely engineered periodic variations in structural geometry, allowing wave control features to scale with the structure itself. The field of elastic metamaterials possessing unique dispersive features including tunable band gaps, topological edge states, and negative effective properties has received increased attention in recent years. Most recently, novel configurations have been presented as pathways to break one of the fundamental elastodynamic principles, reciprocity, and onset a diode-like behavior. Reciprocity, often used in conjunction with principles of superposition and symmetry, is useful for many analysis methods in electromagnetism, acoustics, and signal processing—in practice, however, back scattered waves present a number of issues and limitations in sensing, structural fidelity, telecommunication, and defense applications. Therefore, structures that exhibit a robust non-reciprocal wave propagation behavior are needed.

Linear systems with space-time modulated material fields have been the focus of a number of efforts to investigate wave amplification and non-reciprocity. Due to the time dependence of their properties, these systems are no longer bound by the reciprocity, while their response remains amplitude-independent, unlike nonlinear counterparts. The theoretical problem of characterizing elastic wave propagation in space-time modulated systems has been investigated in one- and two-dimensional structures using plane wave expansion. Recently, this approach has been further extended to discretely modulated structures to better adapt with practical situations. Non-reciprocal waves have also been witnessed in locally resonant systems and elastic metamaterial beams. Nonetheless, the realization of time modulated elastic systems remains a practical challenge due to their dynamic nature. A select number of efforts have conceived ways to realize non-reciprocal media. These include photo-elasticity, magneto-elastic effects, piezoelectric materials, geometric non-linearity, and gyroscopic action via angular momentum modulations.

DESCRIPTION OF THE DRAWINGS

For a fuller understanding of the nature and objects of the disclosure, reference should be made to the following detailed description taken in conjunction with the accompanying drawings, in which:

FIG. 1(*a*) illustrates a conventional metabeam with discretely located resonators. FIG. 1(*b*) illustrates a space-time variation of resonators' stiffness traveling in the negative direction of the x-axis to induce artificial linear momentum bias. FIG. 1(*c*) illustrates a exemplary embodiment of a spatially modulated resonator stiffness in an elastic metabeam. FIG. 1(*d*) illustrates an angular orientation of resonators in a unit-cell to create the spatial modulation. FIG. 1(*e*) illustrates a stiffness variation of rectangular cross sections with various aspect ratios versus angular orientation.

FIG. 2(*a*) illustrates low stiffness (all resonators at $\theta=90°$) and FIG. 2(*b*) illustrates high stiffness ($\theta=0°$). Shaded regions indicate band gaps. Mode shapes pre, within, and post both band gaps are provided for reference. Metabeam parameters identical to those listed in FIGS. 3(*a*) to 3(*f*).

FIG. 3(*a*) illustrates a thermal imaging camera. FIG. 3(*b*) illustrates a scanning Laser Doppler Vibrometer (SLDV) imaging system. FIG. 3(*c*) illustrates a beam excitation module and the signal sent to the piezoelectric actuator. FIG. 3(*d*) illustrates a power and controller circuit. FIG. 3(*e*) illustrates a unit cell (bottom half, close-up). FIG. 3(*f*) shows a metabeam in an experimental apparatus.

FIG. 4(*a*) illustrates quasi-static modulation regime with motors rotating at 100 rpm (1.67 Hz). Experimentally reconstructed dispersion patterns and transmission spectra obtained from backward (CCW rotation) and forward (CW rotation) modulated structures show reciprocal response with fairly symmetrical counter-propagating modes due to low speed modulation. FIG. 4(*b*) illustrates a close-up of 1750-2050 Hz. FIG. 4(*c*) illustrates a close-up of 1250-1550 Hz. FIG. 4(*d*) illustrates a dynamic modulation regime with motors rotating at 2000 rpm (33.3 Hz). Experimentally reconstructed dispersion patterns and transmission spectra obtained from backward (CCW) and forward (CW) modulated structures show non-reciprocal tilt equal to the exact amount of the motors' rotational speed for counter-propagating modes. FIG. 4(*e*) illustrates a close-up of 1750-2050 Hz. FIG. 4(*f*) illustrates a close-up of 1250-1550 Hz.

DETAILED DESCRIPTION OF THE DISCLOSURE

Figure 1:
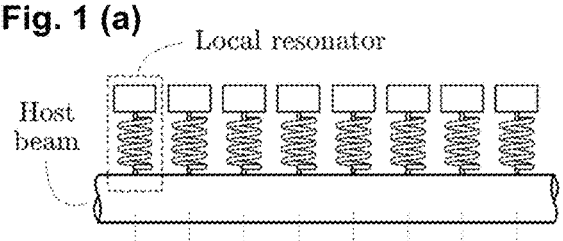
FIGS. 1(*a*)-1(*d*) illustrate a schematic representation of the operational principles of the non-reciprocal metabeam.
Figure 1:
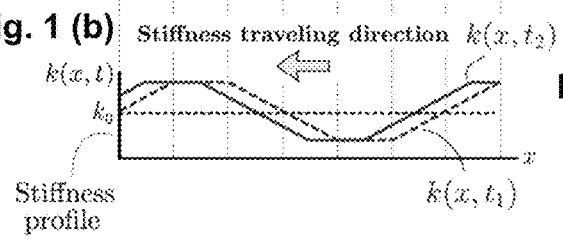
Figure 1:
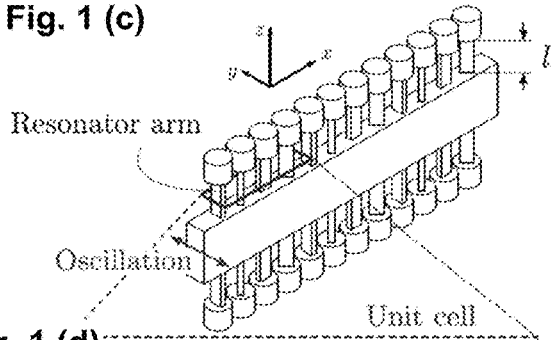
Figure 1:
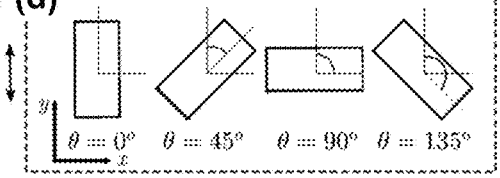
Figure 1:
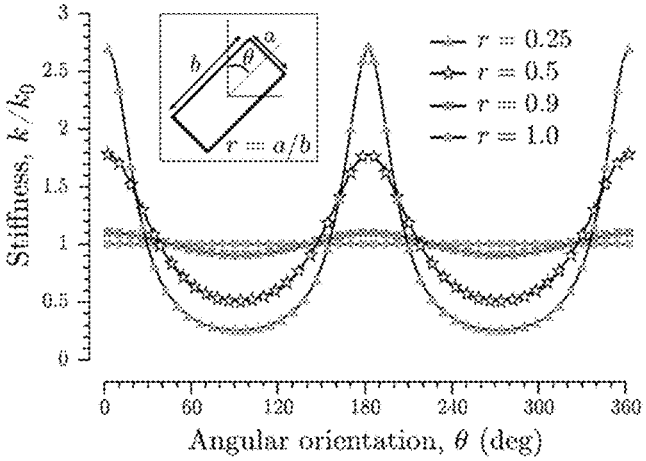

Although claimed subject matter will be described in terms of certain embodiments, other embodiments, including embodiments that do not provide all of the benefits and features set forth herein, are also within the scope of this disclosure. Various structural, logical, process step, and electronic changes may be made without departing from the scope of the disclosure. Accordingly, the scope of the disclosure is defined only by reference to the appended claims.

Ranges of values are disclosed herein. The ranges set out a lower limit value and an upper limit value. Unless otherwise stated, the ranges include all values to the magnitude of the smallest value (either lower limit value or upper limit value) and ranges between the values of the stated range.

Embodiments disclosed herein may enable a mechanical device that transmits energy in one direction only and blocks any disturbances coming from an opposing end. Such a novel system may have large implications in the robotics, automotive, and aerospace industries.

Space-time-varying materials may deliver non-reciprocal dispersion in linear systems by inducing an artificial momentum bias. Although such a paradigm may eliminate the need for actual motion of the medium, experimental realization of space-time structures with dynamically changing material properties has been elusive. The present disclosure presents embodiments comprising an elastic metamaterial that exploits stiffness variations in an array of geometrically phase-shifted resonators—rather than external material stimulation—to induce a temporal modulation. The inventors have experimentally demonstrated that the resulting bias breaks time-reversal symmetry in the resonant metamaterial, and achieves a non-reciprocal tilt of dispersion modes within dynamic modulation regimes.

Embodiments may utilize an array of cantilever resonators, which may be attached to a host beam. The resonators may comprise a non-axisymmetric cross-section, which may render their elastic properties (e.g., stiffness) a function of their geometric orientation. As such, a prescribed phase shift between the resonators may be used to generate a spatial modulation of the beam's stiffness. This phase shift may be later accompanied with a uniform rotation, which may be induced via a series of small, embedded motors to induce the required spatiotemporal elastic profile.

Some embodiments may be embodied in robotic platforms. Robots may require a mechanism by which a central actuating unit can effectively communicate (e.g., send signals) to the outer limbs and sensors while, at the same time, be shielded and protected from external excitations and disturbances. Such a mechanism may be advantageously realized via a metamaterial with the aforementioned one-way wave propagation capabilities.

Some embodiments may be embodied in aerospace structures. Particularly, embedded-engine exhaust panels or exhaust-wash-structures in modern stealth flight vehicles may be prone to fatigue failure caused at least in part by a combination of the low-cycle thermal loading and high-cycle mechanical and acoustic loading. Some research efforts have shown that nonlinearities arising from the thermoelastic loading may significantly influence the static (e.g., stability and stress distribution) and acoustic characteristics of the loaded structures. Attenuation and filtering may take place in metamaterials by virtue of "band gaps," which are functions of material assemblies and mechanical resonances as opposed to low-stiffness dampers and rubber absorbers. As such, they provide an opportunity to suppress the propagation of elastic waves through such structures at frequencies of interest with minimal trade-offs in strength and load-bearing ability, positively influencing the durability and lifetime of such components.

In this work, we present a novel apparatus that achieves space-time modulation of elastic stiffness in a sub-wavelength configuration that does not necessarily involve smart or adaptive materials with inter-physical couplings. The system, which may be designed and constructed using widely available components and manufacturing techniques, comprises a sub-wavelength elastic metamaterial beam (or metabeam, for short) and relies on local resonators that dynamically vary their effective stiffness by changing their angular orientation with respect to the vibration direction. Such a behavior has been recently used to tune locally resonant band gaps. In addition to breaking wave propagation symmetry, the proposed design inherits the tunability of frequency band gaps in conventional metamaterials, which in turn extends the non-reciprocal behavior to low frequencies.

The non-reciprocal metabeam is conceptually akin to a locally resonant metamaterial as depicted in FIG. 1(*a*) and its well-established dynamics. The spring stiffness in each resonator, however, is varied independently in time, and by controlling the macroscopic spatial distribution of the resonators' stiffness, a space-time traveling profile is achieved. FIG. 1(*b*) shows an example of the necessary effective stiffness variation to create non-reciprocity; the stiffness k(x, t) is graphed for two time instants, $t_1$ and $t_2$. The curve k(x, $t_2$) is identical to k(x, $t_1$) except for a spatial phase shift. The means of achieving this stiffness variation may be advantageous for both research and practical implementation purposes.

Considering a beam with rectangular cross section (hereafter referred to as resonator arm) as the spring member, as shown in FIG. 1(*c*), the lateral stiffness under Euler-Bernoulli theory is given by $k=3EI_x/l^3$, where E is the elastic modulus, l is the arm length, and $I_x$ is the second area moment of arm cross section calculated perpendicular to the vibration direction. We propose that the stiffness variation can be achieved by making use of the second area moment of the resonator arm instead of controlling its elastic modulus E. For a resonator rotated by the angle θ, the value of $I_x$ can be computed by using the principle axes values and a coordinate rotation: let x' and y' be the principle axes for one resonator arm; the relevant moment of area for vibration in the y direction as depicted in FIG. 1(*c*) is $I_x=I_0+I_1\cos(2\theta)$, where $$I_0 = \frac{1}{2}(I_{x'} + I_{y'}) \text{ and } I_1 = \frac{1}{2}(I_{x'} - I_{y'}).$$

Figure 2:
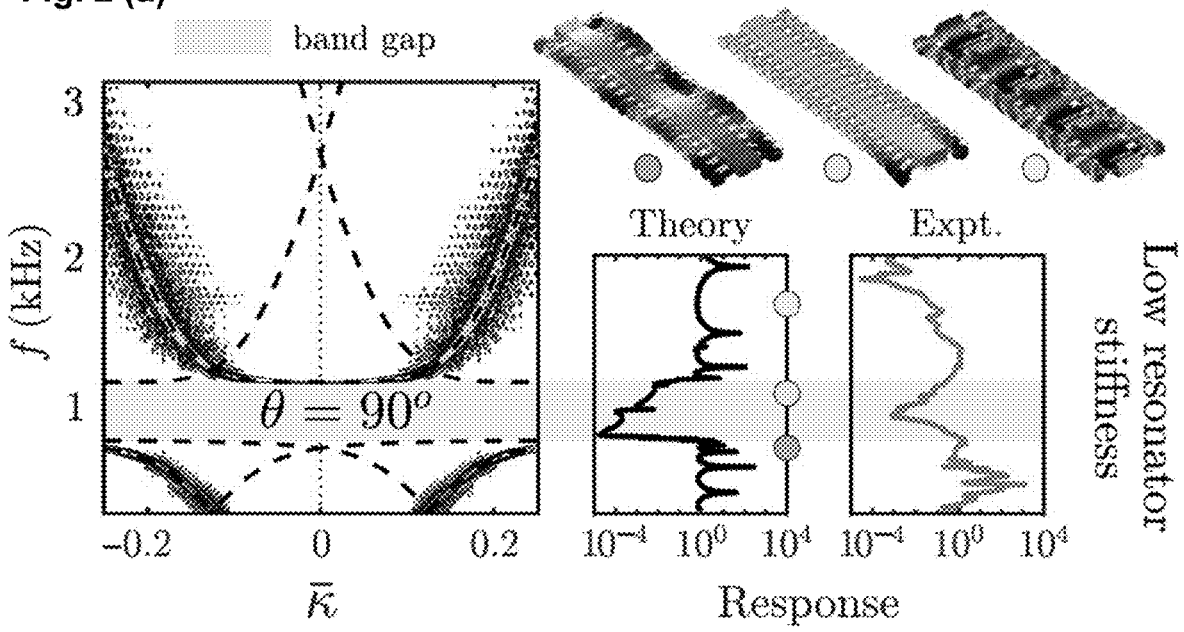
FIGS. 2(*a*)-2(*b*) illustrate dispersion behavior and transmission spectra of the metabeam in two non-rotating configurations.
Figure 2:
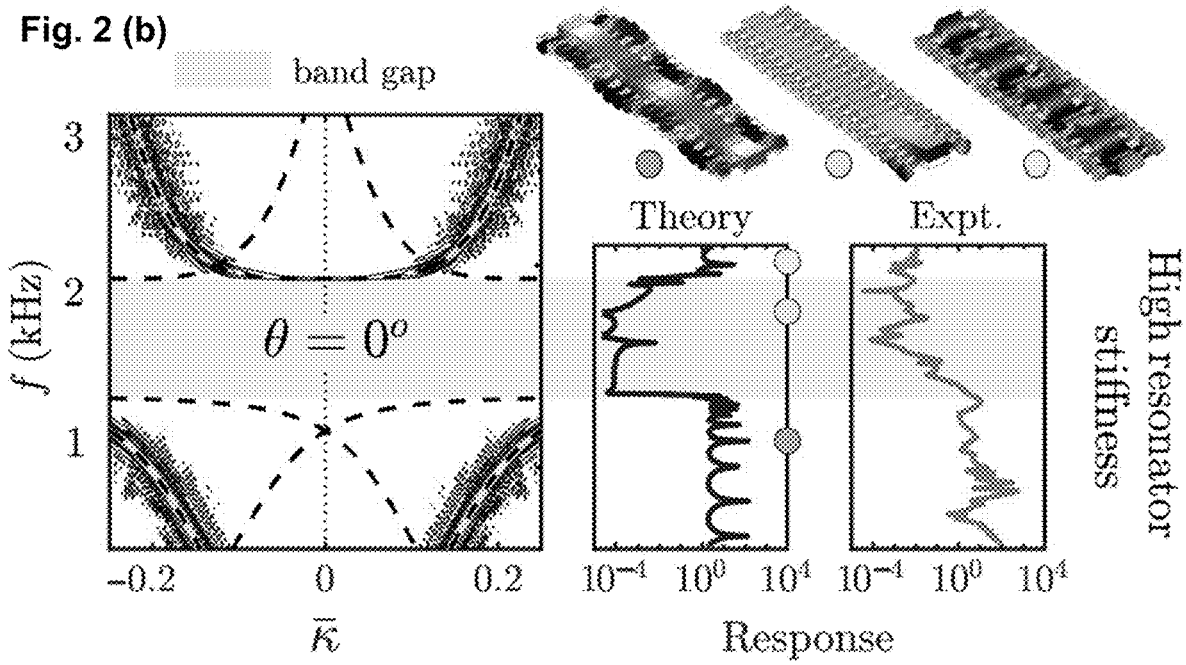

Note that the difference in magnitude between the two principle moments is responsible for the alternating variation of $I_x$ and in turn the variation in the resonator stiffness. A series of finite element numerical simulations were carried out to verify the change in stiffness as a result of the resonator angular rotation. FIG. 1(*e*) shows the stiffness variation with respect to the angular orientation for rectangular cross sections with aspect ratios r=0.25, 0.5, 0.9, and 1. FIG. 1(*e*) confirms that a lower aspect ratio results in a greater variation in the arm stiffness as it rotates; the stiffness variation starts deviating from a perfect harmonic variation due to violation of Euler-Bernoulli beam assumptions at lower aspect ratios. The dependence of band gaps on resonator orientation is shown in literature and confirmed by studying the metamaterial in two different non-rotating configurations, as depicted in FIG. 2. Dispersion diagrams and the corresponding transmission spectra confirm that energy propagation in the metabeam can be dramatically altered by changing only the orientation of the resonators by 90° to switch from the lowest to the highest stiffness configurations (a band gap shift of nearly 400 Hz). Matching experimental results, obtained from the setup outlined in the subsequent section, are also provided.

Figure 3:
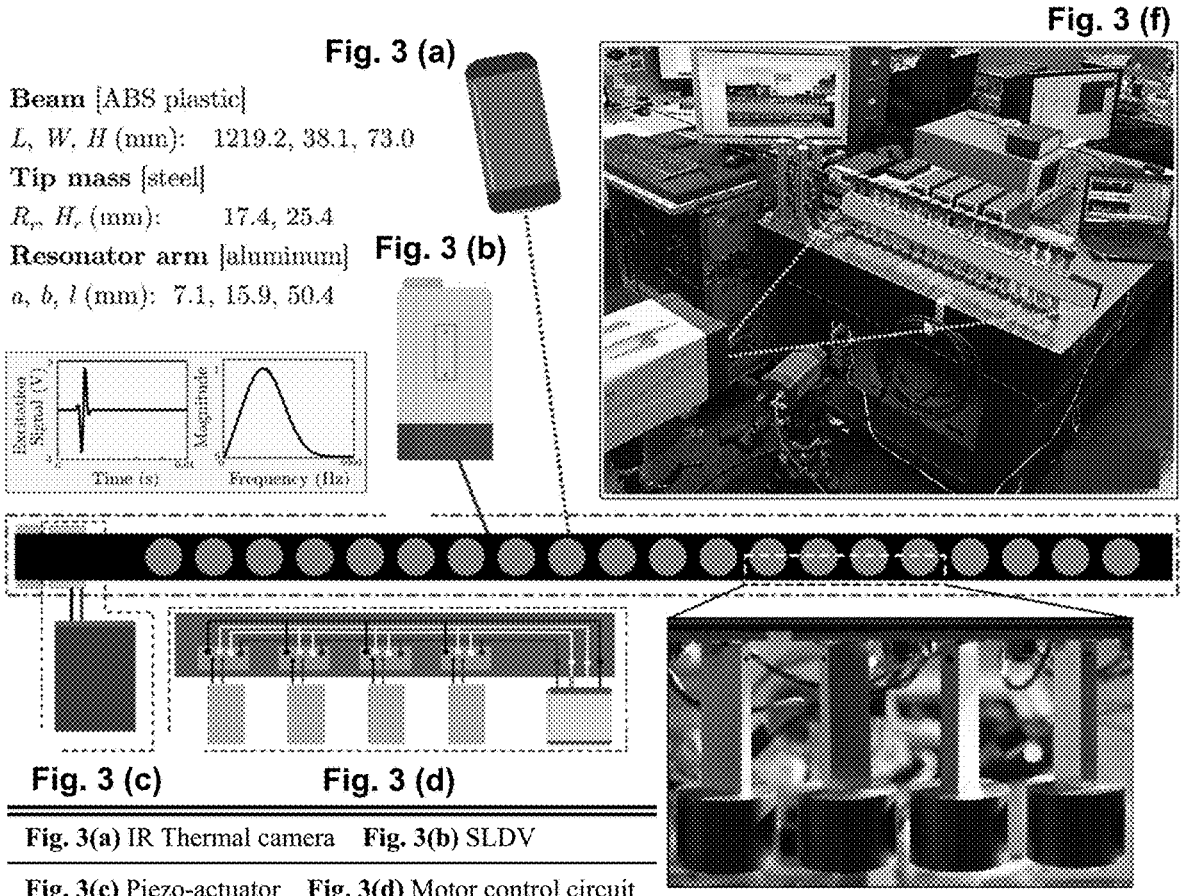
FIGS. 3(*a*) to 3(*f*) illustrate a complete experimental apparatus for the non-reciprocal elastic metabeam.

The host beam in FIG. 1(*c*) is of length L, width W and height H, and is equipped with a series of local resonators that each comprise a prismatic arm with dimensions a, b and l, and a tip mass with a radius $R_r$ and a height $H_r$. FIG. 1(*d*) shows the angular orientation of the resonators in one unit cell in a metabeam with spatially modulated resonator stiffness. Each resonator is rotated by 45° relative to the previous one such that a repeating unit cell is made up of four local resonators. Let the index j denote a single resonator (more specifically a pair of resonators at the same x location on the beam, top and bottom); a unit cell on the metabeam comprises J resonator pairs. As such, a prescribed phase shift between the resonators angular orientation (45° adjacent resonators) generates a spatial modulation of the stiffness. The space-time modulation of the resonators' stiffness is achieved by a synchronized rotation of the resonators' arms with an angular velocity of ωp while maintaining the aforementioned spatial modulation. The combined effect of both spatial and temporal variation induces the desired wavelike stiffness pumping. The stiffness of the jth resonator at time t is $k^{(j)}(t)=k_0+k_1\cos(\omega_p t+2\pi j/J)$. The metabeam was constructed following the general operating principles as shown in FIGS. 1(*a*)-(*e*). The setup comprises the host beam, forty local resonators grouped into symmetric pairs above and below the beam, and motors to control the resonator angle, along with the measurement and excitation systems, as illustrated in FIGS. 3(*a*)-3(*f*). The metabeam is represented by a black rectangle with the local resonators as circles, similar to a bird's eye view of the actual apparatus, in FIG. 3(*f*). The stepper motors were controlled with a custom driver array (FIG. 3(*d*)). Vibration measurements were taken with a Polytec PSV-500 Scanning Laser Doppler Vibrometer (SLDV), illustrated in FIG. 3(*b*). The temperature of the beam was continuously monitored with a FLIR A325sc thermal imaging camera (FIG. 3(*a*)) to ensure that the stiffness of the host structure did not vary due to heating or cooling. Actuators in the form of two extender piezoelectric plates (and a high voltage amplifier, FIG. 3(*c*)) were mounted symmetrically on both sides of the beam and operated 180° out of phase such that transverse vibrations were dominantly excited. The motors and piezoelectric actuators were directly controlled using Lab VIEW and an NI DAQ. Further, the SLDV system was triggered using the same controller in order to ensure that the measurements were synchronous with the prescribed temporal modulation of the metabeam. A close-up view of one unit cell in the metabeam is shown in FIG. 3(*e*) revealing the angular phase shifts between adjacent resonators in one cell. The time domain signal that was sent to the high voltage amplifier was a wide-band tone burst excitation with a central frequency of 1500 Hz.

For more details on the experimental setup, operation, and measurement synchronization, see EXAMPLE 1.

Spatial and temporal Fourier transformations are performed on the SLDV velocity field data to extract the frequency content of propagating waves, and the result is then normalized by the excitation spectrum. By adopting a cantilever beam configuration with the ability to reverse the motor direction, we can effectively double the length of the beam without increasing the size of the structure: waves traveling from the piezoelectric actuator while the motors are rotating clockwise (CW) can be treated as waves traveling in the opposite direction while the motors are rotating counter-clockwise (CCW).

The metabeam was tested at two different modulation regimes, quasi-static and dynamic, based on the rotational speed of the motors, for both CW and CCW rotations. EXAMPLE 1 demonstrates the apparatus in operation.

In the quasi-static modulation regime, the motors were rotated at a relatively low speed, 100 rpm (1.67 Hz), compared to the natural frequencies of the resonators, which are higher than 1000 Hz.

In addition, the resonators were oriented in a way to realize a spatially periodic variation of stiffness along the structure (similar to what is shown in FIG. 1(*c*)). The combination of the spatial phase shift and the low-speed motor rotation generates space-time modulation of stiffness that slowly creeps along the metabeam. With a CCW direction command, a backward modulation appears that is moving from the end to the root of the beam, while a CW command results in a forward modulation. This slow variation of stiffness is reminiscent of adiabatic pumping in quantum mechanical systems. Despite the proven unconventional topological aspects of such system, here we limit our attention to the spectral properties of the metabeam and dispersion characteristics rather than topological features of the modes. The metabeam was tested in both CW and CCW rotations at 100 rpm and FIG. 4(*a*) illustrates the experimentally retrieved dispersion and transmission of the metabeam within the frequency range of interest, 600 to 3000 Hz. The right half-plane of the dispersion contours corresponds to the CCW rotation and the left half-plane corresponds to the CW rotation, which are shown along with their respective transmissions in FIG. 4(*a*).

Note that the repeated flat lines in the dispersion plots (and alternating peaks in the spectra) are artifacts of the stepping frequency of the stepper motors that occurs at 200 times the rotational frequency (or 333.3 Hz); bipolar stepper motors with 1.8° advance per step impart both the main harmonic and 200 times its frequency. These lines are kept in the results to maintain originality and reproducibility of the data. Due to their reciprocal nature, the motor vibration artifacts do not interfere with our interpretation of the results, as they perfectly match in CCW and CW dispersion patterns regardless of the modulation speed. From the close-up views in FIG. 4(*b*) and FIG. 4(*c*) we conclude that insignificant non-reciprocity between the forward and backward dispersion modes exists for this case. As intended, the traveling speed of the modulation (or the speed of motors) in the quasi-static modulation regime is insufficient to instigate detectable non-reciprocal response regardless of the rotational direction of the motors.

Figure 4:
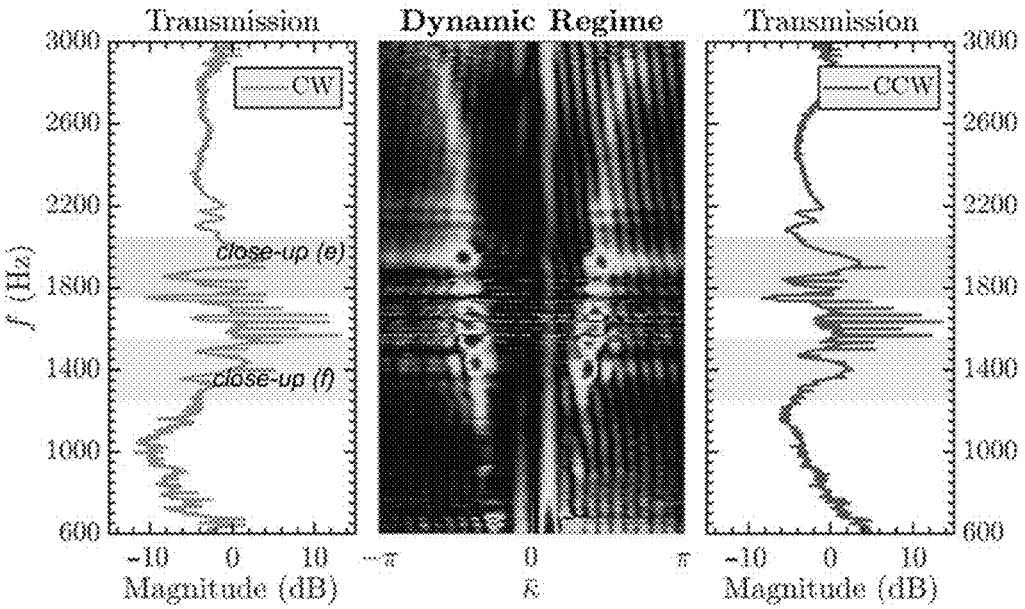
FIGS. 4(*a*)-4(*f*) illustrate experimental results.
Figure 4:
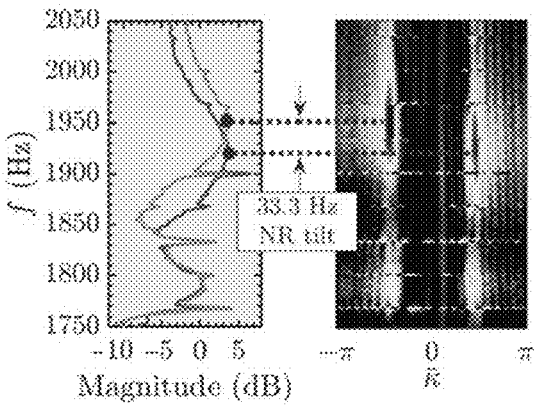
Figure 4:
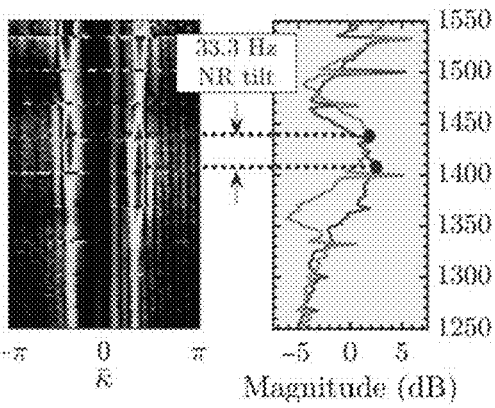
Figure 5:
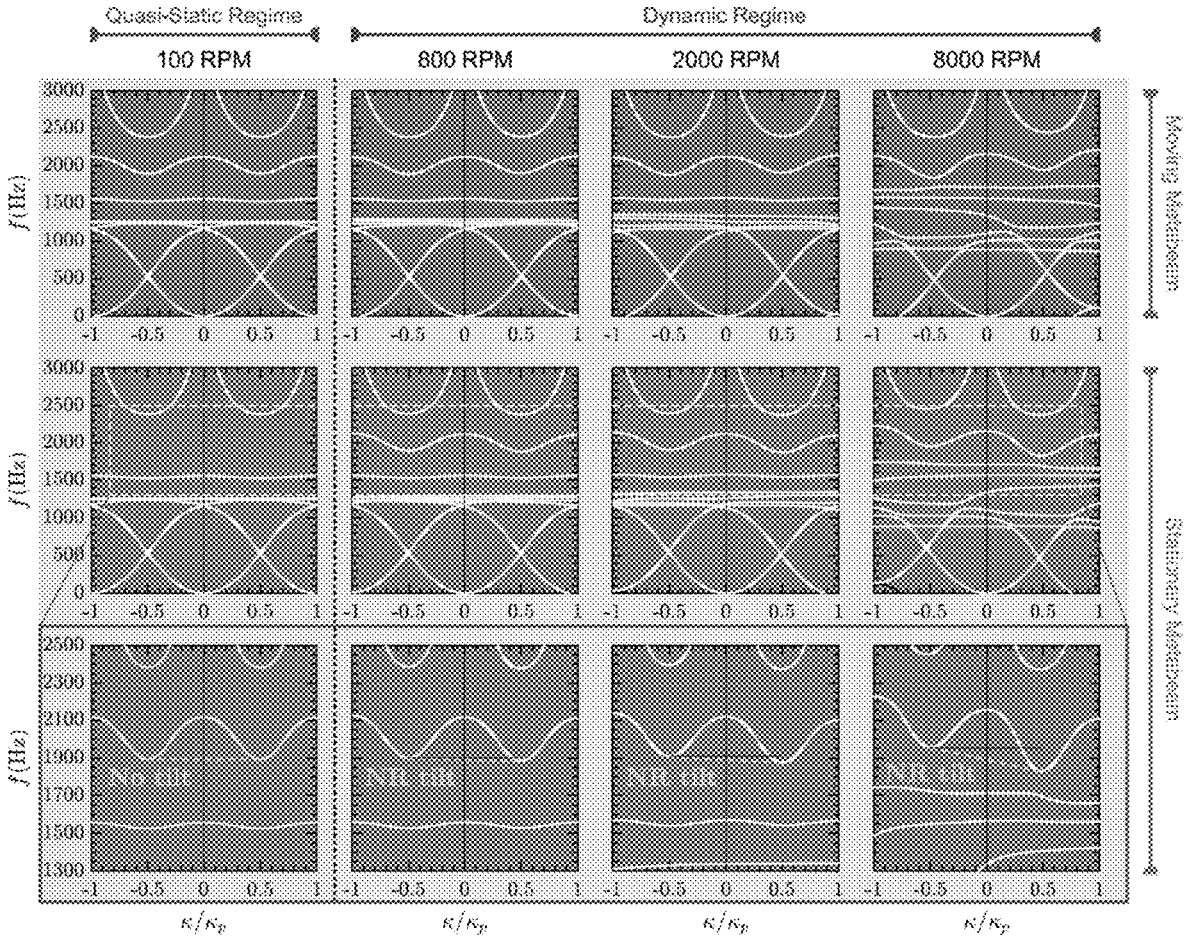
FIG. 5 Dispersion plots for the metabeam modulated at quasi-static and three different dynamic regimes. The first and second rows correspond to the moving and stationary space-time modulated metabeam, respectively. The third row is a close-up of the second revealing the band tilting.

In the dynamic modulation regime, we intentionally increase the rotational speed of the motors to 2000 rpm (33.3 Hz) while maintaining the spatial modulation (angular position phase shift between the successive resonators). The result is a much faster traveling modulation and is shown in FIG. 4(*d*) along with the transmission spectra for both forward and backward modulations. As observed from the close-up views in FIG. 4(*e*) and FIG. 4(*f*), the faster modulation speed in the dynamic regime generated one-way modal transition and detectable non-reciprocal tilt of the dispersion modes. As a result, the rightward propagating branch is down-shifted by the amount of 33.3 Hz (equal to the modulation speed, or rotational speed of motors) compared to the left propagating branch, which indicates the effectiveness of the proposed metabeam to break time-reversal symmetry.

In accordance with the previous findings on reciprocity breakage in space-time modulated systems the frequency shift between the forward and the backward propagating branches is an integer multiple of the modulation frequency. Accordingly, the non-reciprocity can be further accentuated by increasing the rotational speed of the motors. The one-way transmission at a given frequency can also be switched in the opposite direction by simply rotating motors in the opposite direction.

The present disclosure presents a dynamically modulated metamaterials that do not rely on material response to external stimulus, but rather an inherent geometric attribute by design. A cornerstone feature of flexural materials, second area moment, was used to geometrically induce a space-time modulation and, consequently, enforce an artificial linear momentum bias to break time-reversal symmetry of waves in an elastic beam. It was experimentally demonstrated that non-reciprocal tilt of the dispersion modes is directly correlated with the modulation speed of the medium and can be adjusted all the way from complete reciprocal dispersion in the quasi-static regime to a complete non-reciprocal dispersion in the dynamic modulation regime. Non-reciprocal metamaterials may be embodied in, for example, back scatter-free ultra-sonic imaging and sensor-actuator protection to duplex underwater communications, SONAR devices and non-reciprocal acoustic phased array radars.

The steps of any methods described in the various embodiments and examples disclosed herein are sufficient to carry out the methods of the present invention. Thus, in an embodiment, the method consists essentially of a combination of the steps of the methods disclosed herein. In another embodiment, the method consists of such steps.

Example 1—Observation of Non-Reciprocal Waves in a Resonant Metamaterial Beam The below example provides figures and additional description according to some embodiments of the present disclosure.

1. Wave Propagation Dynamics

This section presents the dispersion mechanics of propagating elastic waves in the presently-disclosed metamaterial beam to show the underlying physics leading to the non-reciprocity. We start by assuming that each resonator can be ideally represented by a tip mass m and a stiffness k, and is separated from surrounding ones by a distance $\ell$. The stiffness profile generated as a result of the prescribed shifted angular orientation of resonators and motor rotation is shown in FIG. 1*b*, and in the long wavelength regime, can be well-approximated by:

$$k(x, t) = k_0 + k_1\cos(\omega_p t + \kappa_p x) \tag{1}$$

where $k_0$ and $k_1$ are the mean and alternating components of the stiffness variation respectively. $\kappa_p=2\pi/(J\ell)$ is spatial modulation frequency and op is the temporal pumping frequency. The pumped stiffness variation therefore travels with a speed $v_p=-\omega_p/\kappa_p$ (the negative sign denoting the traveling direction is the opposite x-axis). That means the higher the rotational speed of motors, the faster the stiffness variation travels. We approximate the vibration of the local resonators with a continuous function u(x, t), and denote the lateral displacement of the host beam by w(x, t). Considering a mass per unit length of $\bar{\mu}$ and a bending stiffness of $\bar{S}$ for the host beam, we can write the governing equations as:

$$\bar{\mu}\frac{\partial^2 w}{\partial t^2} + \bar{S}\frac{\partial^4 w}{\partial x^4} = \frac{1}{\ell}k(x, t)[u(x, t) - w(x, t)] \tag{2a}$$

$$m\frac{\partial^2 u}{\partial t^2} = k(x, t)[w(x, t) - u(x, t)] \tag{2b}$$

Besides being space-periodic, the relationships in Eq. (2) are temporally periodic due to the existence of k(x, t). To avoid complications associated with time varying systems, we resort to an approach that replaces Eq. (2) with its time-invariant equivalent and has been proven useful by the inventors. First, we assume that the metabeam described by Eq. (2) is also physically moving in the opposite direction of the traveling material property. With the metabeam moving at the appropriate speed, the property variation (here, k(x, t)) appears entirely time-invariant to a stationary observer. Next, the dispersion analysis is carried out on the time-invariant system and finally, the dispersion plots are transformed to the original system using a predefined linear coordinate transformation. Accordingly, we augment Coriolis and centripetal terms to the equations of motion to account for the added actual motion; therefore we have:

$$\mu\left(\frac{\partial^2 w}{\partial t^2} + 2v\frac{\partial^2 w}{\partial t\partial x} + v^2\frac{\partial^2 w}{\partial x^2}\right) + S\frac{\partial^4 w}{\partial x^4} = k(x)[u(x, t) - w(x, t)] \tag{3a}$$

$$m\left(\frac{\partial^2 u}{\partial t^2} + 2v\frac{\partial^2 u}{\partial x\partial t} + v^2\frac{\partial^2 u}{\partial x^2}\right) = k(x)[w(x, t) - u(x, t)] \tag{3b}$$

where $S=\bar{S}\ell$, $\mu=\bar{\mu}\ell$, and the prescribed speed of the translation is $$v = \frac{\omega_p}{\kappa_p} = -v_p.$$

In short, Eq. (3) describes a metabeam moving in space with a space-time stiffness modulation traveling in the opposite direction. The problem is now time-invariant since the stiffness profile appears as $k(x)=k_0+k_1\cos(\kappa_p x)$ to a stationary observer, and instead, the Coriolis terms $$\left(2v\frac{\partial^2 w}{\partial t\partial x} \text{ and } 2v\frac{\partial^2 u}{\partial t\partial x}\right)$$

conventional dispersion analysis approaches like such as the Transfer Matrix Method (TMM). However, let us assume a plane wave solution for the beam displacement as $w(x, t)=We^{i(\omega t-\kappa x)}$, and the resonator displacement as $u(x, t)=Ue^{i(\omega t-\kappa x)}$, where frequency is $\omega$ and the wavenumber is $\kappa$, and the harmonic amplitudes are W and U. Hence:

$$[\kappa^4 S + k_0 - \mu(\omega - \kappa v)^2]W - k_0 U = -\frac{k_1}{2}[W_{(+1)} + W_{(-1)} - U_{(+1)} - U_{(-1)}] \tag{4a}$$

$$[k_0 - m(\omega - \kappa v)^2]U - k_0 W = \frac{k_1}{2}[W_{(+1)} + W_{(-1)} - U_{(+1)} - U_{(-1)}] \tag{4b}$$

The subscript, $(\bullet)_{(+q)}$ with $q\in\mathbb{Z}$, is a shorthand notation for up- or down-shifted wavenumber by the amount of $\kappa_p$, i.e., $W_{(\pm1)}$ is equal to $W(\kappa\pm\kappa_p)$ and likewise for other terms-assuming the dependence on $\omega$ is implicit. By adding the two Eqs. 4a and 4b, and solving for U, we get:

$$U = \frac{\kappa^4 S - \mu(\omega - \kappa v)^2}{m(\omega - \kappa v)^2} W \tag{5}$$

and substitute this expression back into Eq. (4a) yields:

$$aW + b_{(+1)}W_{(+1)} + b_{(-1)}W_{(-1)} = 0 \tag{6}$$

where:

$$a(\omega, \kappa) = \kappa^4 S - \mu(\omega - \kappa v)^2 + k_0\left(1 - \frac{\kappa^4 S - \mu(\omega - \kappa v)^2}{m(\omega - \kappa v)^2}\right) \tag{7a}$$

$$b(\omega, \kappa) = \frac{k_1}{2}\left(1 - \frac{\kappa^4 S - \mu(\omega - \kappa v)^2}{m(\omega - \kappa v)^2}\right) \tag{7b}$$

From Eq. (7b) we observe that in absence of stiffness modulation ($k_1$=0) we have $b_{(\pm 1)}$=0. The result is a zeroth order approximation, a(ω, κ)=0, that describes the dispersion modes of a moving metabeam with invariant resonators' stiffness. In order to derive a first order approximation, however, we make use of the recursive nature of Eq. (6) by shifting the subscripts up and down by the amount $\kappa_p$ to find:

$$a_{(+1)}W_{(+1)} + b_{(+2)}W_{(+2)} + bW = 0 \tag{8a}$$

$$a_{(-1)}W_{(-1)} + bW + b_{(-2)}W_{(-2)} = 0 \tag{8b}$$

By neglecting terms of second or higher harmonics, we solve for $W_{(\pm 1)} = -bW/a_{(\pm 1)}$ and $W_{(-1)} = -bW/a_{(-1)}$. Substituting these expressions back into Eq. (6), gives $$a - b\left(\frac{b_{(+1)}}{a_{(+1)}} + \frac{b_{(-1)}}{a_{(-1)}}\right) = 0 \tag{9}$$

The additional terms in Eq. (9) are first order corrections to the zeroth order dispersion relation, which incorporate resonator stiffness modulation in the dispersion physics. It can be shown that the exact dispersion relation can be obtained by replacing $a_{(\pm 1)}$ in Eq. (9) with $a^*_{(\pm 1)}$ where, $$a^*_{(q)} = a_{(q)} - b_{(q)}\frac{b_{(q+1)}}{a^*_{(q+1)}};\ q \in \mathbb{Z} \tag{10}$$

As such, a third order dispersion relation, for instance, is:

$$a - b\left\{\frac{b_{(+1)}}{a_{(+1)} - b_{(+1)}\left[\frac{b_{(+2)}}{a_{(+2)} - b_{(+2)}\frac{b_{(+3)}}{a_{(+3)}}}\right]} + \frac{b_{(-1)}}{a_{(-1)} - b_{(-1)}\left[\frac{b_{(-2)}}{a_{(-2)} - b_{(-2)}\frac{b_{(-3)}}{a_{(-3)}}}\right]}\right\} = 0 \tag{11}$$

FIG. 6 shows 3rd-order dispersion plots for a metabeam with bending stiffness S=29.71 N $m^3$, mass μ=0.1731 kg, resonator tip mass m=0.18 kg, mean resonator stiffness $k_0=1.35\times10^7$ N/m, alternating resonator stiffness $k_1=0.342k_0$, and modulated at both quasi-static and dynamic regimes. The first row of plots shows results for a moving space-time modulated metabeam, which as viewed by a stationary observer appears time-invariant. As mentioned earlier, in order to reverse the effect of the actual motion from the dispersion plots, a linear coordinate transformation (vertical shear mapping) is applied on the ω-κ plane of the moving system. The transformation is is given by:

$$\begin{Bmatrix} \kappa \\ \omega \end{Bmatrix}_S = \begin{bmatrix} 1 & 0 \\ -v & 1 \end{bmatrix} \begin{Bmatrix} \kappa \\ \omega \end{Bmatrix}_M \tag{12}$$

where the subscript S denotes the stationary frame and M the moving frame. The dispersion plots depicted in the second row of FIG. S1 correspond to the original stationary system with space-time modulation of resonator stiffness, which are obtained by transforming the first row. From the zoomed view in the third row, we can observe the existence of asymmetry in the dispersion plots of the dynamic modulation regime which is a clear indication of breakage of time-reversal symmetry, and also a qualitative indicator of the nature of the waves that can propagate within the structure. Traveling waves with κ>0 travel in the positive x-direction, and waves with κ<0 travel in the negative x-direction. Therefore, with two distinct dispersion modes that are different for waves traveling in the positive or negative x-direction—as is demonstrated in FIG. S1, the waves in a specific frequency range will be blocked only if they are traveling in one direction. This behavior is characteristic of a frequency dependent mechanical diode. Hence, the analytical results in the preceding section predict that the elastic metabeam outlined in this letter breaks reciprocity.

2. Experimental Method and Details

The metabeam was manufactured from conventional machining techniques, making it an attractive and scalable option for non-reciprocal wave propagation without the need for exotic materials. A solid ABS plastic beam was CNC-machined to a length of 48 in., width of 1.50 in., and height of 2.875 in. The front face of the ABS plastic beam was covered with white retro-reflective tape to improve the SLDV signal quality. A series of 40 pockets were cut out from the beam to house NEMA 8 bipolar stepper motors. The motors were attached to aluminum plates in groups of four; the aluminum plates were then fixed to the host beam such that the motors were secured to the beam and fit snugly in the pockets. The resonator arms were secured to the stepper motor shafts with two set screws, and the tip masses were secured to the arms using a machine screw. The resonators were each individually adjusted to within 0.010 in. of concentricity (runout) between the motor shaft and the tip mass outer diameter to minimize vibrations induced into the structure when the arms were rotating. The motors were controlled with a custom driver array constructed of widely available microstepping breakout boards. Each pair of resonators (top and bottom) were wired in parallel to a single driver; the drivers were grouped into sets of five and attached to a power supply. The driver arrays were wired in parallel with a control signal from a NI USB-6341 Multi-purpose DAQ. On the rising edge of the step command, the motors advanced 1.8° in a clockwise (CW) or counter-clockwise (CCW) direction depending on the direction signal. As the motors were all wired in parallel, a single step command would move all the motors at once with nearly perfect synchronicity. This also allowed for the excitation chirp signal and the SLDV measurement to be synchronized with the time variation of the structure itself.

In a typical test, the motors were commanded to accelerate to a speed of 2000 rpm (33.3 Hz) and, after maintaining this speed for roughly 10 minutes (in order to collect data with the SLDV system), commanded to decelerate to a stop: throughout one such maneuver the motors received 3,731,600 step commands and were observed to return to their original position to within an average error of less than one step. The angular position precision provided by the stepper motors was essential to maintain the spatial phase difference between adjacent resonators, and therefore ensured that the traveling stiffness wave was consistent throughout the experimental trials. Stepper motors presented some challenges in that their maximum torque output is limited based on the size constraints for embedding the motors within the beam. We found that 2000 rpm was the highest speed we were able to run a set of robust and trustworthy tests where the resonators rotate uniformly and consistently. Moreover, when operating the stepper motors, each discrete step of the rotor induced a small vibration into the structure; this vibration was reciprocal, however, and can be observed in the results in the main text. The reciprocal waves induced by the steps of the motors did not impact the non-reciprocity demonstrated via the traveling stiffness wave interacting with the wide band excitation. Maintaining a constant host structure temperature throughout the test runs was also a challenge due to the motors being confined within the pockets. It was found that with sufficient convection cooling the structure would maintain a steady-state temperature while operating at the testing conditions. Great care was taken in observing the steady-state temperature behavior of the beam using an infrared thermal imaging camera to ensure that the temperature did not vary during the experimental runs.

In order to recover the non-reciprocal wave dispersion patterns in the metabeam, it was necessary to take time domain measurements under a wide-band impulsive excitation. The challenge in using an SLDV system to measure the vibration of a time-varying structure lies in synchronizing the measurement start time with the state of the structure itself for every data point or measurement location. In a time-invariant system, an SLDV triggers the excitation and controls the measurement to ensure that the final results can be used to reconstruct a coherent data set. With a time-periodic structure, however, the SLDV must be triggered by an external controller to make certain that the measurements at each spatial point are taken at the same phase with respect to the system's time variation. For example, if measurement at point 1 was taken when the resonators were at an angle of 10° relative to their initial position, and measurement at point 2 was taken with the resonators at any other arbitrary angle, the system behavior could not be reconstructed using the two data sets since they are effectively measuring different systems. Therefore, the Lab VIEW controller was used to trigger the vibrometer on a specified integer number of resonator rotations such that each measurement at a given point in space started with the motors at the same orientation, regardless of their rotational velocity. Triggering the vibration excitation, measurement, and system time variations with a single controller was essential to ensuring the data was consistent.

Although the present disclosure has been described with respect to one or more particular embodiments, it will be understood that other embodiments of the present disclosure may be made without departing from the scope of the present disclosure.

What is claimed is:

1. A metabeam with nonreciprocal dispersion, comprising:

a host beam having a length L along a longitudinal axis and configured to vibrate over its length wherein the vibration is in a first direction perpendicular to the length of the host beam; and a plurality of first resonators arranged in an array along the length of the host beam and extending from the host beam in a second direction which forms an angle>0° with respect to the first direction and an angle>0° with respect to the longitudinal axis of the host beam; each first resonator comprising:

an arm having a first end attached to the host beam and an arm axis, wherein the arm has a stiffness in the first direction which is selectively variable; and a mass attached to the arm at a location which is spaced from the first end by a distance d; and wherein the stiffness of each first resonator arm is configured to be varied to impart nonreciprocal dispersion in the host beam.

2. The metabeam of claim 1, wherein the stiffness of each first resonator arm is configured to be continuously varied at a frequency f.

3. The metabeam of claim 2, wherein the stiffness of at least one first resonator is phase-shifted with respect to the stiffness of an adjacent first resonator of the plurality of first resonators.

4. The metabeam of claim 1, wherein each arm is rotatable about the arm axis, and wherein each arm has a first stiffness in a first dimension and a second stiffness in a second dimension such that the stiffness of the arm in the first direction can be varied by rotating the arm.

5. The metabeam of claim 4, further comprising a plurality of motors, each motor coupled to a resonator of the plurality of first resonators and configured to rotate the arm of the associated first resonator about the arm axis.

6. The metabeam of claim 5, wherein each motor of the plurality of motors is configured to continuously rotate the arm of the associated first resonator at a frequency f.

7. The metabeam of claim 6, wherein at least one motor of the plurality of motors is phase-shifted from an adjacent motor of the plurality of motors.

8. The metabeam of claim 1, further comprising a plurality of second resonators in an array along the length of the host beam and extending from the host beam in a third direction which is opposite to the second direction; each second resonator comprising:

an arm having a first end attached to the host beam and an arm axis, wherein the arm has a stiffness in the first direction which is selectively variable; and a mass attached to the arm at a location which is spaced from the first end by a distance d.

9. The metabeam of claim 1, wherein the second direction is 90° with respect to the first direction and/or the longitudinal axis of the host beam.

* * * * *